US011634832B2

(12) United States Patent
Hou et al.

(10) Patent No.: US 11,634,832 B2
(45) Date of Patent: Apr. 25, 2023

(54) PLATING SYSTEM AND METHOD OF PLATING WAFER

(71) Applicant: TAIWAN SEMICONDUCTOR MANUFACTURING COMPANY LIMITED, Hsin-Chu (TW)

(72) Inventors: Kuo-Lung Hou, Taichung (TW); Ming-Hsien Lin, Taichung (TW)

(73) Assignee: TAIWAN SEMICONDUCTOR MANUFACTURING COMPANY LIMITED, Hsin-Chu (TW)

( * ) Notice: Subject to any disclaimer, the term of this patent is extended or adjusted under 35 U.S.C. 154(b) by 0 days.

(21) Appl. No.: 17/308,347

(22) Filed: May 5, 2021

(65) Prior Publication Data

US 2022/0356596 A1 Nov. 10, 2022

(51) Int. Cl.

| | |
|---|---|
| ***C25D 21/12*** | (2006.01) |
| ***C25D 7/12*** | (2006.01) |
| ***C25D 17/02*** | (2006.01) |
| ***C25D 5/54*** | (2006.01) |
| ***C25D 17/00*** | (2006.01) |

(52) U.S. Cl.
CPC ..... *C25D 21/12* (2013.01); *C25D 5/54* (2013.01); *C25D 7/12* (2013.01); *C25D 17/001* (2013.01); *C25D 17/02* (2013.01)

(58) Field of Classification Search
CPC ..... C25D 7/12–123; C25D 17/001; H01L 21/2885; H01L 21/76873
See application file for complete search history.

(56) References Cited

U.S. PATENT DOCUMENTS

2017/0058417 A1* 3/2017 Graham ..... C25D 17/001

* cited by examiner

*Primary Examiner* — Ho-Sung Chung
(74) *Attorney, Agent, or Firm* — Cooper Legal Group, LLC

(57) ABSTRACT

A plating system is provided. The plating system includes an electroplating chamber defining a plating region within which a wafer is plated. The electroplating chamber includes an inlet configured to introduce plating solution into the plating region of the electroplating chamber. The electroplating chamber includes an outlet configured to remove the plating solution from the plating region of the electroplating chamber. The plating system includes a barrier configured to inhibit removal of the plating solution from the plating region.

20 Claims, 11 Drawing Sheets

PLATING SYSTEM AND METHOD OF PLATING WAFER

BACKGROUND

Semiconductor wafers are used in a multitude of electronic devices, such as mobile phones, laptops, desktops, tablets, watches, gaming systems, and various other industrial, commercial, and consumer electronics. Semiconductor wafers generally undergo one or more processes to produce desired features.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

DETAILED DESCRIPTION

Figure 1:
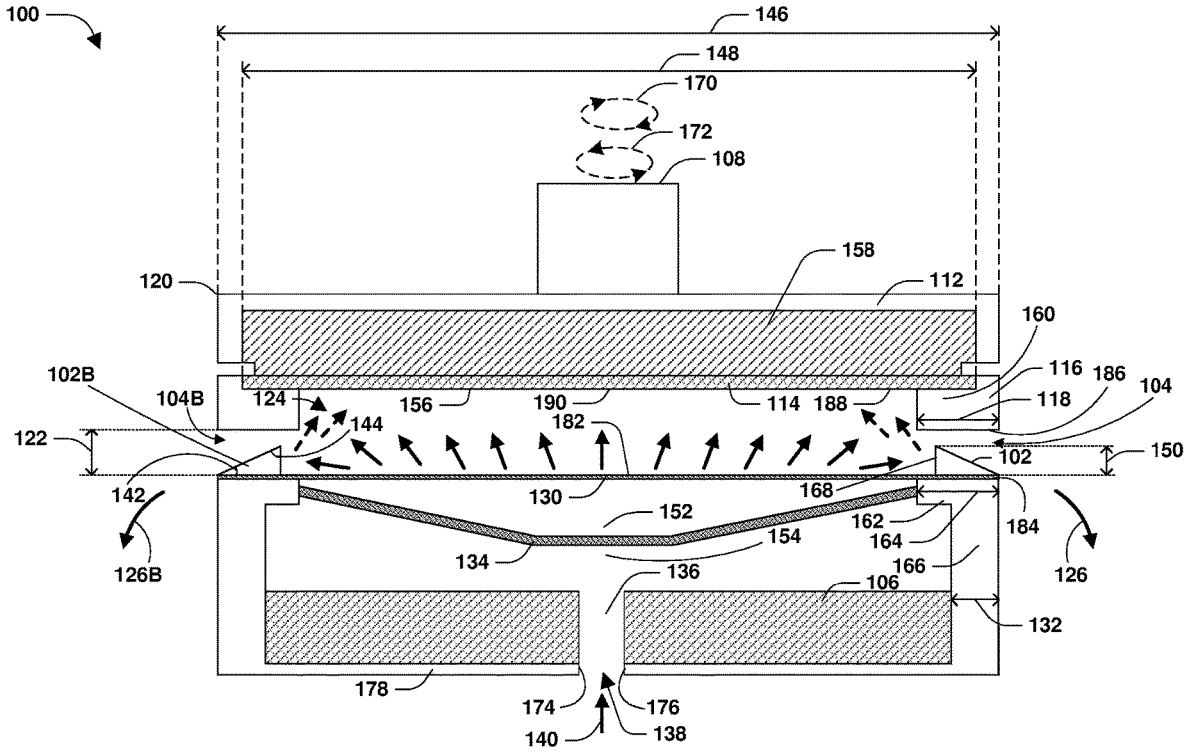
FIG. 1 illustrates a cross-sectional view of at least some of a plating system, in accordance with some embodiments.

The following disclosure provides several different embodiments, or examples, for implementing different features of the provided subject matter. Specific examples of components and arrangements are described below to simplify the present disclosure. These are, of course, merely examples and are not intended to be limiting. For example, the formation of a first feature over or on a second feature in the description that follows may include embodiments in which the first and second features are formed in direct contact and may also include embodiments in which additional features may be formed between the first and second features, such that the first and second features may not be in direct contact. In addition, the present disclosure may repeat reference numerals or letters in the various examples. This repetition is for the purpose of simplicity and clarity and does not in itself dictate a relationship between the various embodiments or configurations discussed.

Further, spatially relative terms, such as "beneath," "below," "lower," "above," "upper" and the like, may be used herein for ease of description to describe one element or feature's relationship to other element(s) or feature(s) as illustrated in the figures. The spatially relative terms are intended to encompass different orientations of the device in use or operation in addition to the orientation illustrated in the figures. The apparatus may be otherwise oriented (rotated 90 degrees or at other orientations) and the spatially relative descriptors used herein may likewise be interpreted accordingly.

A plating system has an electroplating chamber defining a plating region within which a wafer is plated. The electroplating chamber has an inlet configured to introduce plating solution into the plating region of the electroplating chamber and an outlet configured to remove the plating solution from the plating region of the electroplating chamber. The plating system has a barrier configured to inhibit removal of the plating solution from the plating region. At least some of the plating solution flowing towards and/or through the outlet is reflected by the barrier back into the plating region and/or towards the wafer. The barrier provides for increased uniformity of flow or distribution of the plating solution impinging upon the wafer, as compared to plating systems that do not include the barrier. The increased uniformity of flow or distribution of the plating solution impinging upon the wafer provides for an increased uniformity of a plating thickness of plating material deposited across a surface of the wafer. The increased uniformity of the plating thickness of the plating material across the surface of the wafer provides for more accurate fabrication of semiconductor devices and enables fabrication of semiconductor devices with smaller feature sizes.

FIGS. 1-4 illustrate a plating system 100 according to some embodiments. The views depicted in FIGS. 1-4 are cross-sectional views to illustrate some internal aspects of the plating system 100. With respect to FIG. 1, the plating system 100 comprises an electroplating chamber 120 defining a plating region 124 within which a wafer 114 is plated. The plating system 100 is configured to perform a plating process to plate the wafer 114 with a plating material, such as for fabrication of one or more semiconductor devices. The plating material is deposited onto a surface 156 of the wafer 114.

A distance 146 between opposing outer sidewalls of the electroplating chamber 120 is between about 35 millimeters to about 3,500 millimeters (such as about 350 millimeters). A length 148 of the wafer 114 is between about 30 millimeters to about 3,000 millimeters (such as about 300 millimeters). Other structures and/or configurations of the electroplating chamber 120 and/or the wafer 114 are within the scope of the present disclosure.

The plating system 100 comprises an anode 106. In some embodiments, the anode 106 is within the electroplating chamber 120. The plating material deposited onto the surface 156 of the wafer 114 depends upon a material composition of the anode 106. The plating material comprises anode material transferred from the anode 106 to the wafer 114, such as to the surface 156 of the wafer 114, during the plating process. The anode 106 and the plating material comprise at least one of copper, nickel, tin, or other suitable material.

The electroplating chamber 120 comprises an inlet 138 configured to introduce plating solution 140, such as an electrolyte, into the plating region 124 of the electroplating chamber 120. In some embodiments, the electroplating chamber 120 is coupled to a tube (such as a first tube 650, a second tube 652, or a third tube 654 shown in FIG. 6) at the inlet 138. The plating solution 140 exits the tube and enters the electroplating chamber 120 via the inlet 138. The inlet 138 corresponds to an opening defined in a bottom chamber wall 178 of the electroplating chamber 120 or other portion of the electroplating chamber 120. In some embodiments, the inlet 138 is defined by a first sidewall 174 of the bottom chamber wall 178 and a second sidewall 176 of the bottom chamber wall 178. In some embodiments, the plating system 100 comprises a pump (such as a first pump 610, a second pump 614, or a third pump 618 shown in FIG. 6) configured to conduct the plating solution 140 into the plating region 124 of the electroplating chamber 120 via the tube and the inlet 138 of the electroplating chamber 120. One or more valves, sealants, O-rings, etc. can exist at the inlet 138 to afford control over the flow of the plating solution 140 from the tube to the electroplating chamber 120. In some embodiments, an opening 136 in the anode 106 overlies the inlet 138 of the electroplating chamber 120. The plating solution 140 flows through the inlet 138 and the opening 136 in the anode 106. Other structures and/or configurations of the electroplating chamber 120 and/or the inlet 138 are within the scope of the present disclosure.

A material composition of the plating solution 140 depends on at least one of the plating material or the material composition of the anode 106. In some embodiments, at least one of the plating material or the anode 106 comprise copper and the plating solution 140 comprises copper sulfate. Other compositions of the plating solution 140, the plating material, and/or the anode 106 are within the scope of the present disclosure.

The plating system 100 comprises a power source (not shown) that is electrically coupled to the anode 106 and a cathode, such as the wafer 114. The power source is configured to pass current, such as direct current, through the plating solution 140 such that the anode 106 loses electrons and the wafer 114 becomes negatively charged. Loss of electrons at the anode 106 causes some of the anode material of the anode 106 to at least one of dissolve into the plating solution 140 or be converted into ions, such as positively charged metal ions. The ions from the anode 106 flow through the plating region 124, such as through and/or with the plating solution 140, to the wafer 114. The ions are at least one of neutralized, reduced, or deposited onto the wafer 114, such as deposited onto the surface 156 of the wafer 114.

In some embodiments, the plating system 100 comprises a membrane 134 in the electroplating chamber 120. The membrane 134 separates a first section 154 of the plating region 124, such as a section of the plating region 124 under the membrane 134, from a second section 152 of the plating region 124, such as a section of the plating region 124 over the membrane 134. The plating solution 140 flows, such as through the membrane 134, from the first section 154 of the plating region 124 to the second section 152 of the plating region 124. The membrane 134 is configured to at least one of inhibit or block flow of one or more components, such as one or more types of plating additives of the plating solution 140, from flowing from the first section 154 of the plating region 124 to the second section 152 of the plating region 124. Accordingly, a material composition of the plating solution 140 in the first section 154 is different than a material composition of the plating solution 140 in the second section 152. An amount of plating additives, such as an amount of at least one of levelers, suppressers, or accelerators, in the first section 154 is greater than an amount of plating additives in the second section 152. In some embodiments, the plating solution 140 in the second section 152 is a virgin makeup solution (VMS). A VMS is a solution that does not contain one or more types of plating additives, such as at least one of levelers, suppressers, or accelerators.

The membrane 134 is coupled to a support structure 162 of the electroplating chamber 120. In some embodiments, the membrane 134 is coupled to a first inner sidewall of the support structure 162. The support structure 162 overlies a chamber wall 166 of the electroplating chamber 120. A distance 164 between a first outer sidewall of the support structure 162 and the first inner sidewall of the support structure 162 is between about 2 millimeters to about 200 millimeters (such as about 20 millimeters). A distance 132 between a second outer sidewall of the chamber wall 166 and a second inner sidewall of the chamber wall 166 is between about 1 millimeter to about 100 millimeters (such as about 10 millimeters). Other structures and/or configurations of the membrane 134, the support structure 162, and/or the chamber wall 166 are within the scope of the present disclosure.

At least one of ions from the anode 106 or the plating solution 140, such as the plating solution 140 in the second section 152, flow towards the wafer 114 and impinge upon the wafer 114, such as at the surface 156 of the wafer 114. In some embodiments, the plating system 100 comprises a high resistance virtual anode (HRVA) 130 in the electroplating chamber 120. The HRVA 130 comprises a non-conductive material, such as at least one of a polymer material or other suitable material. The non-conductive material of the HRVA 130 has an electrical resistance higher than an electrical resistance of the wafer 114. The HRVA 130 is a porous structure through which at least one of the ions from the anode 106 or the plating solution 140 flow. The HRVA 130 comprises openings, such as vertically oriented through holes, through which at least one of the ions from the anode 106 or the plating solution 140 flow and impinge upon the wafer 114. The HRVA 130 overlies at least one of anode 106, the membrane 134 or the support structure 162. The HRVA 130 is between the wafer 114 and at least one of the membrane 134 or the anode 106. Other structures and/or configurations of the HRVA 130 are within the scope of the present disclosure.

Inclusion of the HRVA 130 in the electroplating chamber 120 increases uniformity of current distribution across the surface 156 of the wafer 114 and decreases a difference between current densities across different portions of the surface 156 of the wafer 114, and thus provides for an increased uniformity of flow or distribution of the ions from the anode 106 impinging upon the surface 156 of the wafer 114, as compared to electroplating chambers that do not include the HRVA 130. The increased uniformity of flow or distribution of the ions from the anode 106 impinging upon the surface 156 of the wafer 114 provides for an increased uniformity of a plating thickness of the plating material deposited across the surface 156 of the wafer 114.

In some embodiments, the electroplating chamber 120 comprises wafer engaging components, such as "clamshell" components. The wafer engaging components comprise at least one of a cone 158 or a wafer support structure 116, such as a cup. The cone 158 overlies the wafer 114. In some embodiments, the electroplating chamber 120 comprises a plate 112 overlying the cone 158. The wafer support structure 116 is configured to maintain a position of the wafer 114 between the cone 158 and at least one of the anode 106, the membrane 134 or the HRVA 130. A portion 160 of the wafer support structure 116 underlies the wafer 114 such that the wafer 114 is secured in the wafer support structure 116. A distance 118 between a third outer sidewall of the wafer support structure 116 and a third inner sidewall of the wafer support structure 116 is between about 2 millimeters to about 200 millimeters (such as about 20 millimeters). A distance 122 between the HRVA 130 and the wafer support structure 116 is between about 1 millimeter to about 100 millimeters (such as about 10 millimeters). One or more portions of the wafer 114, such as one or more surfaces of the wafer 114 other than the surface 156, are covered by at least one of the cone 158 or the wafer support structure 116. The one or more portions of the wafer 114 that are covered are not plated during the plating process. Other structures and/or configurations of the cone 158, the wafer support structure 116 and/or the plate 112 are within the scope of the present disclosure.

In some embodiments, the plating system 100 comprises a rotational structure 108. The rotational structure 108 is configured to rotate at least one of the wafer 114 or at least some of the electroplating chamber 120 in at least one of a first direction 170 or a second direction 172 opposite the first direction 170. The rotational structure 108 is controlled by a motor (not shown). The motor is configured to rotate the rotational structure 108. The rotational structure 108 is coupled to at least one of the plate 112, the cone 158, or other portion of the electroplating chamber 120. In some embodiments, rotation of the wafer 114 using the rotational structure 108 provides for an increased uniformity of a plating thickness of the plating material deposited across the surface 156 of the wafer 114. Other structures and/or configurations of the rotational structure 108 are within the scope of the present disclosure.

The electroplating chamber 120 comprises an outlet 104 configured to remove the plating solution 140 from the plating region 124 of the electroplating chamber 120. In some embodiments, the outlet 104 underlies the wafer support structure 116. The outlet 104 corresponds to an opening in the electroplating chamber 120, such as defined between the wafer support structure 116 and at least one of the HRVA 130, the support structure 162, or the chamber wall 166 of the electroplating chamber 120. In some embodiments, the outlet 104 is defined by a bottom surface 186 of the wafer support structure 116 and at least one of a top surface 182 of the HRVA 130 or a top surface 184 of the support structure 162.

In some embodiments, the electroplating chamber 120 comprises a second outlet 104B opposite the outlet 104. In some embodiments, the outlet 104 and the second outlet 104B are two separate or discrete outlets disconnected from each other. In some embodiments, the outlet 104 and the second outlet 104B are part of a single, continuous outlet extending around at least some of the electroplating chamber 120 between the wafer support structure 116 and at least one of the HRVA 130, the support structure 162, or the chamber wall 166 of the electroplating chamber 120. In some embodiments, removed plating solution 126 and 126B flows from the plating region 124 to outside of the electroplating chamber 120 via the outlet 104 and/or the second outlet 104B.

The plating system 100 comprises a barrier 102, such as a shim, configured to inhibit removal of the plating solution 140 from the plating region 124. The barrier 102 is under at least one of the plate 112, the cone 158, the wafer 114, or the wafer support structure 116. The barrier 102 is over at least one of the HRVA 130, the membrane 134 or the chamber wall 166. The barrier 102 is between the bottom surface 186 of the wafer support structure 116 and at least one of the top surface 182 of the HRVA 130 or the top surface 184 of the support structure 162. The barrier 102 at least one of overlies, is in direct contact with, is in indirect contact with, or is coupled to the top surface 182 of the HRVA 130. The barrier 102 at least one of overlies, is in direct contact with, is in indirect contact with, or is coupled to the top surface 184 of the support structure 162. In some embodiments, a position of the barrier 102 is fixed. In some embodiments, a position of the barrier 102 is adjustable.

In some embodiments, the barrier 102 is configured to recirculate the plating solution 140, flowing towards and/or through the outlet 104, back into the plating region 124 and/or towards the wafer 114. At least some of the plating solution 140 flowing towards and/or through the outlet 104 impinges upon the barrier 102 and is reflected by the barrier 102. Reflected plating solution 140 reflected by the barrier 102 flows at least one of away from the outlet 104, back into the plating region 124 and/or towards the wafer 114, such as in directions shown with dashed arrows in FIGS. 1-4. In some embodiments, the plating system 100 comprises a second barrier 102B opposite the barrier 102. In some embodiments, the barrier 102 and the second barrier 102B are two separate or discrete barriers. In some embodiments, the barrier 102 and the second barrier 102B are part of a single, continuous barrier extending around at least some of the electroplating chamber 120 between the wafer support structure 116 and at least one of the HRVA 130, the support structure 162, or the chamber wall 166 of the electroplating chamber 120. A distance 150 between an uppermost portion of the barrier 102 and at least one of the top surface 182 of the HRVA 130, the top surface 184 of the support structure 162, or a lowermost portion of the barrier 102, is between about 0.6 millimeters to about 60 millimeters (such as about 5.8 millimeters). In some embodiments, the distance 150 corresponds to a height of the barrier 102. Other structures and/or configurations of the barrier 102 are within the scope of the present disclosure.

Inclusion of the barrier 102 in the plating system 100 increases uniformity of flow or distribution of at least one of the plating solution 140 or the ions from the anode 106 impinging upon the surface 156 of the wafer 114, as compared to electroplating chambers that do not include the barrier 102. The increased uniformity of flow or distribution of the ions impinging upon the surface 156 of the wafer 114 provides for an increased uniformity of a plating thickness of the plating material deposited across the surface 156 of the wafer 114. Inclusion of the barrier 102 provides for a reduced difference between a first rate at which at least one of the plating solution 140 or the ions from the anode 106 impinge upon a first portion of the surface 156 of the wafer 114 and a second rate at which at least one of the plating solution 140 or the ions from the anode 106 impinge upon a second portion of the surface 156 of the wafer 114. The reduced difference between the first rate and the second rate provides for a reduced difference between a first plating thickness of the plating material deposited onto the first portion of the surface 156 of the wafer 114 and a second plating thickness of the plating material deposited onto the second portion of the surface 156 of the wafer 114.

Without the barrier 102 in the plating system 100, the first rate is less than the second rate, such as at least due to directions of flow or distribution of at least one of the plating solution 140 or the ions from the anode 106 providing for less of the plating solution 140 and/or the ions impinging upon the first portion of the surface 156 of the wafer 114 than the second portion of the surface 156 of the wafer 114. In some embodiments, inclusion of the barrier 102 modifies the directions of flow or distribution of at least one of the plating solution 140 or the ions from the anode 106 such that impingement of at least one of the plating solution 140 or the ions from the anode 106 upon the first portion of the surface 156 of the wafer 114 increases, thus providing for the reduced difference between the first rate and the second rate and providing for the reduced difference between the first plating thickness and the second plating thickness. In some embodiments, inclusion of the barrier 102 provides for an increase in chemical concentration of the plating solution 140 in a region of the plating region 124 at least one of adjacent to or underlying the first portion of the surface 156 of the wafer 114. In some embodiments, the reduced difference between the first rate and the second rate and/or the reduced difference between the first plating thickness and the second plating thickness are due at least in part to the increase in chemical concentration of the plating solution 140 in the region of the plating region 124 at least one of adjacent to or underlying the first portion of the surface 156 of the wafer 114. In some embodiments, at least one of the first portion of the surface 156 of the wafer 114 corresponds to an edge region 188 of the surface 156 of the wafer 114 or the second portion of the surface 156 of the wafer 114 corresponds to a center region 190 of the surface 156 of the wafer 114.

In some embodiments, a cross-sectional shape of the barrier 102 is triangular, such as at least one of an equilateral triangle, an isosceles triangle, a scalene triangle, a right triangle, an obtuse triangle, or an acute angle. The cross-sectional shape of the barrier 102 has a vertex 144 with an angle between about 45 degrees to about 75 degrees (such as about 60 degrees), a vertex 142 with an angle between about 15 degrees to about 45 degrees (such as about 30 degrees), and a remaining vertex with an angle between about 75 degrees to about 105 degrees (such as about 90 degrees). Other structures and/or shapes of the barrier 102 are within the scope of the present disclosure.

The barrier 102 has an inner sidewall 168 facing the plating region 124. In some embodiments, the inner sidewall 168 extends vertically, such as perpendicular to a direction of extension of at least one of the top surface 182 of the HRVA 130, the top surface 184 of the support structure 162, or the surface 156 of the wafer 114 and/or parallel to a direction of extension of at least one of the first inner sidewall of the support structure 162, the first outer sidewall of the support structure 162, the second inner sidewall of the chamber wall 166, the second outer sidewall of the chamber wall 166, the third inner sidewall of the wafer support structure 116, or the third outer sidewall of the wafer support structure 116. Other structures and/or configurations of the barrier 102 and/or the inner sidewall 168 of the barrier 102 relative to other elements, features, etc. are within the scope of the present disclosure.

Figure 2:
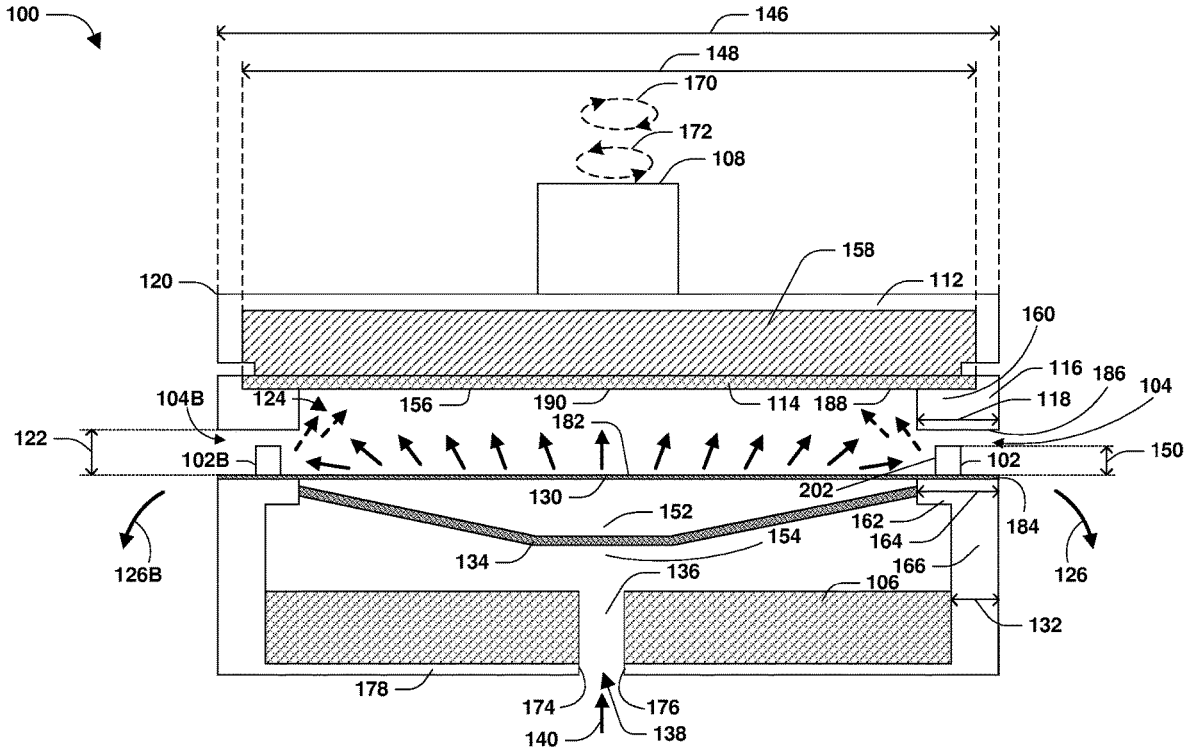
FIG. 2 illustrates a cross-sectional view of at least some of a plating system, in accordance with some embodiments.

FIG. 2 illustrates the plating system 100 according to some embodiments. In some embodiments, such as shown in FIG. 2, a cross-sectional shape of the barrier 102 is rectangular. The barrier 102 has an inner sidewall 202 facing the plating region 124. In some embodiments, the inner sidewall 202 extends vertically, such as perpendicular to a direction of extension of at least one of the top surface 182 of the HRVA 130, the top surface 184 of the support structure 162, or the surface 156 of the wafer 114 and/or parallel to a direction of extension of at least one of the first inner sidewall of the support structure 162, the first outer sidewall of the support structure 162, the second inner sidewall of the chamber wall 166, the second outer sidewall of the chamber wall 166, the third inner sidewall of the wafer support structure 116, or the third outer sidewall of the wafer support structure 116. Other structures and/or configurations of the barrier 102 and/or the inner sidewall 202 of the barrier 102 relative to other elements, features, etc. are within the scope of the present disclosure.

Figure 3:
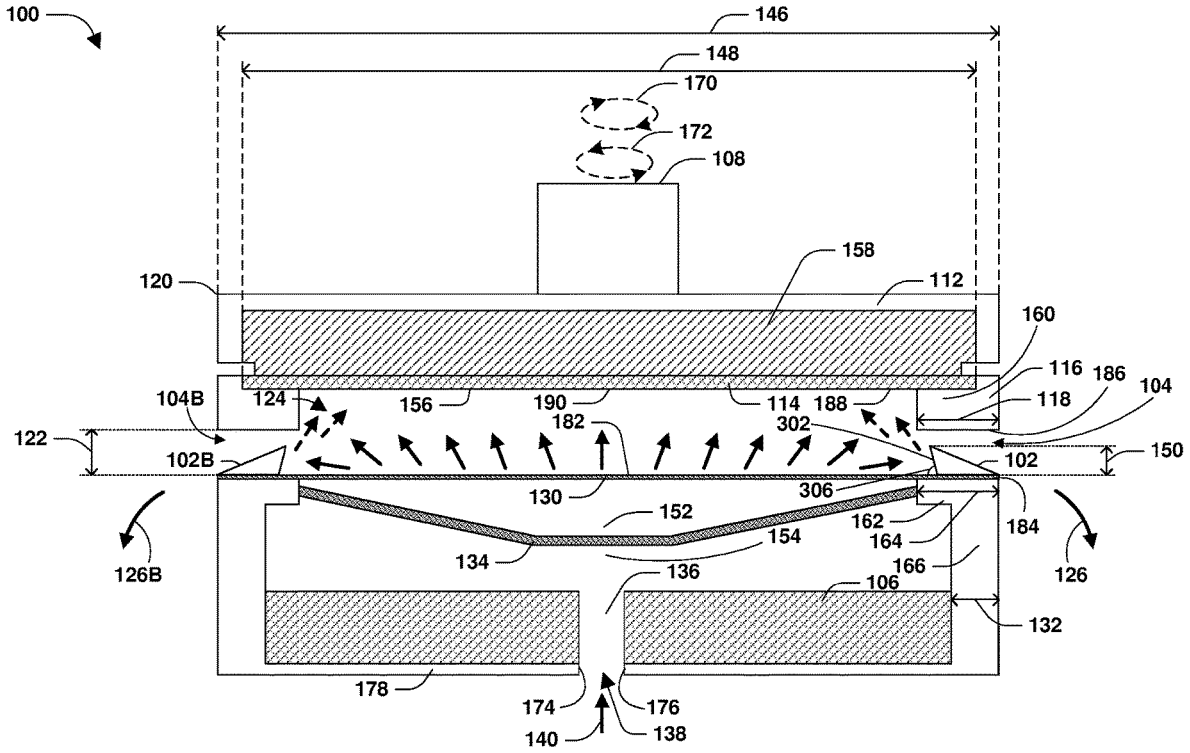
FIG. 3 illustrates a cross-sectional view of at least some of a plating system, in accordance with some embodiments.

FIG. 3 illustrates the plating system 100 according to some embodiments. In some embodiments, such as shown in FIG. 3, a cross-sectional shape of the barrier 102 is triangular and the barrier 102 has an inner sidewall 302 tapered at an angle 306 with respect to at least one of the top surface 182 of the HRVA 130 or the top surface 184 of the support structure 162. The angle 306 of the inner sidewall 302 is between about 30 degrees to about 130 degrees (such as between about 60 degrees to about 100 degrees, or such as about 80 degrees). Other structures and/or configurations of the barrier 102 and/or the inner sidewall 302 of the barrier 102 relative to other elements, features, etc. are within the scope of the present disclosure.

Figure 4:
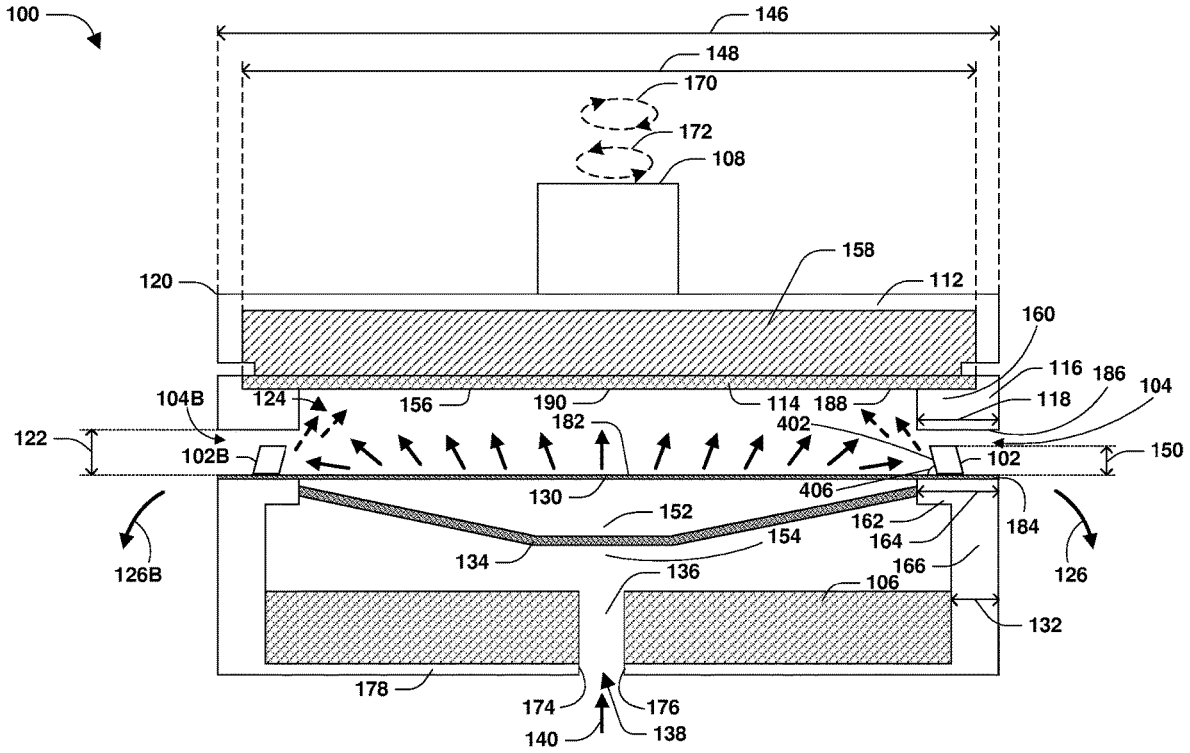
FIG. 4 illustrates a cross-sectional view of at least some of a plating system, in accordance with some embodiments.

FIG. 4 illustrates the plating system 100 according to some embodiments. In some embodiments, such as shown in FIG. 4, a cross-sectional shape of the barrier 102 is a parallelogram and the barrier 102 has an inner sidewall 402 tapered at an angle 406 with respect to at least one of the top surface 182 of the HRVA 130 or the top surface 184 of the support structure 162. The angle 406 of the inner sidewall 402 is between about 30 degrees to about 130 degrees (such as between about 60 degrees to about 100 degrees, or such as about 80 degrees). Other structures and/or configurations of the barrier 102 and/or the inner sidewall 402 of the barrier 102 relative to other elements, features, etc. are within the scope of the present disclosure.

Shapes and/or structures of the barrier 102 other than those shown and/or described with respect to FIGS. 1-4 are within the scope of the present disclosure.

Figure 5A:
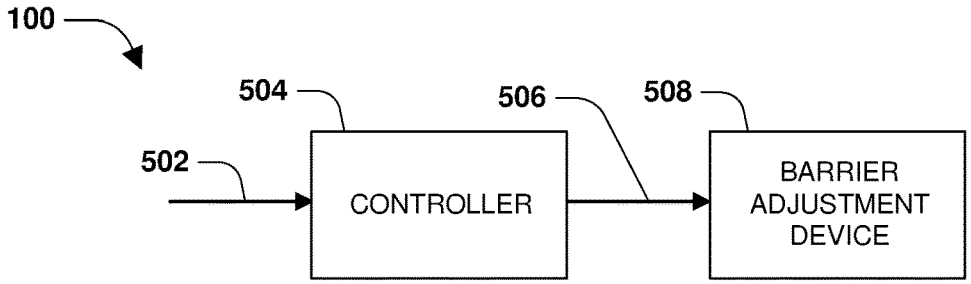
FIG. 5A illustrates a schematic view of at least some of a plating system, in accordance with some embodiments.

FIGS. 5A-5E illustrate a barrier adjustment device 508 of the plating system 100, according to some embodiments. FIG. 5A illustrates a schematic view of the barrier adjustment device 508, according to some embodiments. A controller 504 of the plating system 100 is configured to receive one or more signals 502. The controller 504 is configured to control the barrier adjustment device 508 based upon the one or more signals 502. The controller 504 transmits one or more control signals 506 to the barrier adjustment device 508 based upon the one or more signals 502. The barrier adjustment device 508 is configured to adjust and/or control an orientation and/or a position of the barrier 102 based upon the one or more control signals 506.

In some embodiments, the one or more signals 502 comprise one or more feedback signals. One or more parameters of the plating process are determined, such as by the controller 504, based upon the one or more feedback signals. The one or more parameters comprise at least one of one or more deposition rates, one or more plating thicknesses, one or more pressures of the plating solution 140 in one or more parts of the plating system 100, one or more directions of flow of the plating solution 140 in one or more parts of the plating system 100, or other suitable parameters. The one or more deposition rates correspond to one or more rates at which the plating material is deposited on one or more portions of the surface 156 of the wafer 114. The one or more plating thicknesses correspond to one or more thicknesses of plating material deposited on one or more portions of the surface 156 of the wafer 114. In some embodiments, at least some of the one or more parameters are determined based upon one or more signals, of the one or more feedback signals, received from one or more first sensors, such as at least one of one or more proximity sensors, one or more optical sensors, one or more image sensors, one or more cameras, one or more infrared sensors, one or more pressure sensors, or one or more other suitable sensors. The one or more first sensors comprise one or more sensors positioned in or on the electroplating chamber 120, one or more sensors positioned on the first inner sidewall of the support structure 162, one or more sensors positioned on the second inner sidewall of the chamber wall 166, one or more sensors positioned on the third inner sidewall of the wafer support structure 116, one or more sensors positioned on the HRVA 130, one or more sensors positioned on the membrane 134, one or more sensors positioned in the inlet 138, one or more sensors positioned on the first sidewall 174 of the bottom chamber wall 178, one or more sensors positioned on the second sidewall 176 of the bottom chamber wall 178, one or more sensors positioned in or on the tube (such as the first tube 650, the second tube 652, or the third tube 654 shown in FIG. 6), one or more sensors positioned in the outlet 104, one or more sensors positioned on the bottom surface 186 of the wafer support structure 116, or one or more other sensors positioned at one or more other suitable locations.

Figure 6:
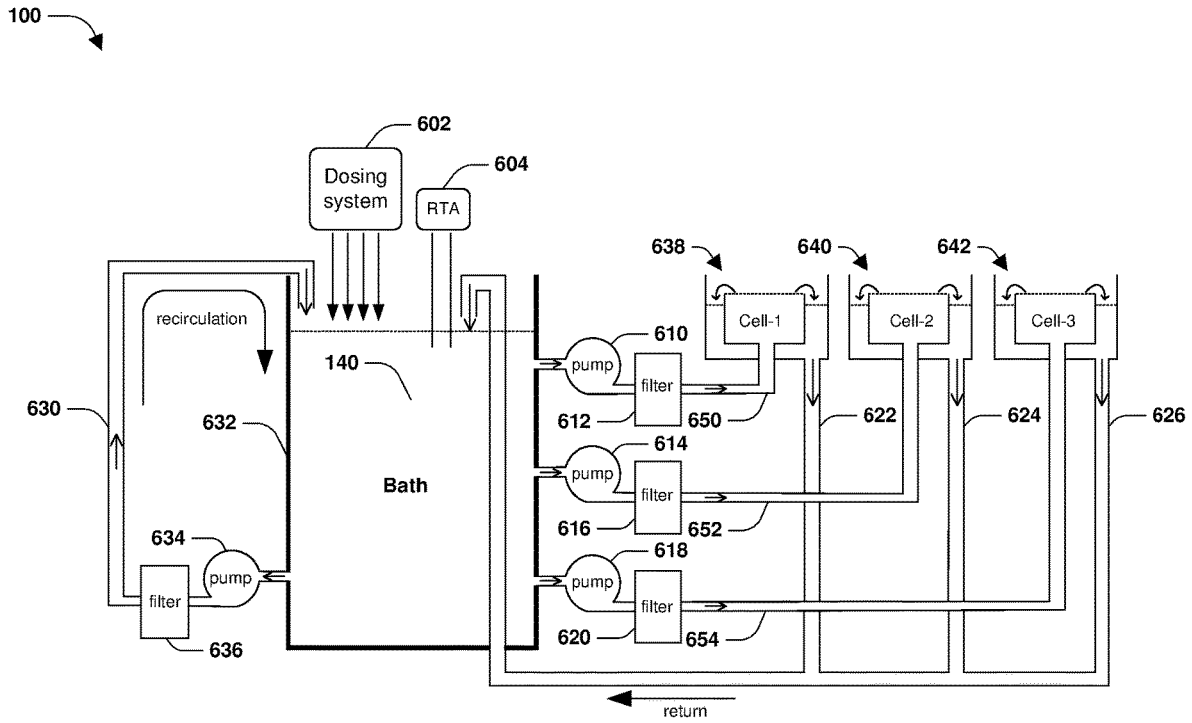
FIG. 6 illustrates a schematic view of at least some of a plating system, in accordance with some embodiments.

In some embodiments, the one or more signals 502 comprise one or more operational signals received from one or more first components of the plating system 100, such as at least one of the pump (such as the pump 610, the pump 614, or the pump 618 shown in FIG. 6), a computer configured to control one or more components of the system, or one or more other suitable components. In some embodiments, the one or more operational signals are indicative of at least one of a rate at which the plating solution 140 is pumped into the electroplating chamber 120, an amount of plating solution 140 pumped into the electroplating chamber 120, one or more properties of the plating solution 140, a material composition of the plating solution 140, a target plating thickness of the plating material on the surface 156 of the wafer 114, a target uniformity of the plating material on the surface 156 of the wafer 114, or one or more other suitable operational parameters.

In some embodiments, the barrier adjustment device 508 comprises at least one of an angle adjustment component 510 (shown in FIG. 5B), a horizontal position adjustment component 526 (shown in FIG. 5C), a vertical position adjustment component 528 (shown in FIG. 5E), or another suitable positional adjustment component.

Figure 5B:
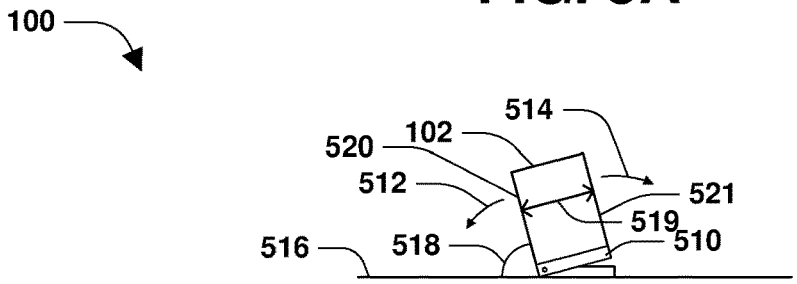
FIG. 5B illustrates a cross-sectional view of at least some of a plating system, in accordance with some embodiments.

FIG. 5B illustrates a cross-sectional view of the angle adjustment component 510 of the barrier adjustment device 508, according to some embodiments. In some embodiments, the angle adjustment component 510 is configured to adjust and/or control an angle 518 of an inner sidewall 520 of the barrier 102 (such as the inner sidewall 168, the inner sidewall 202, the inner sidewall 302, or the inner sidewall 402) with respect to a surface 516 (such as at least one of the top surface 182 of the HRVA 130 or the top surface 184 of the support structure 162). A distance 519 between the inner sidewall 520 of the barrier 102 and an outer sidewall 521 of the barrier 102 is between about 0.1 millimeters to about 20 millimeters (such as about 1 millimeter). In some embodiments, the distance 519 corresponds to a width of the barrier 102. The angle adjustment component 510 at least one of overlies, is in direct contact with, is in indirect contact with, or is coupled to the surface 516. The angle adjustment component 510 is configured to adjust and/or control the angle 518 of the inner sidewall 520 of the barrier 102 with respect to the surface 516 based upon at least one control signal of the one or more control signals 506. In some embodiments, the barrier 102 is coupled to the surface 516, such as via at least one of a hinged connection, a ratcheted connection, or other suitable connection. In some embodiments, the angle adjustment component 510 is coupled to the barrier 102, such as via at least one of a hinged connection, a ratcheted connection, or other suitable connection. In some embodiments, the angle adjustment component 510 is configured to adjust and/or control the angle 518 of the inner sidewall 520 of the barrier 102 with respect to the surface 516 by moving the barrier 102, such as using one or more motors of the angle adjustment component 510, in at least one of a first rotational direction 512 or a second rotational direction 514 opposite the first rotational direction 512. Other structures and/or configurations of the angle adjustment component 510 and/or the barrier 102 are within the scope of the present disclosure.

Figure 5C:
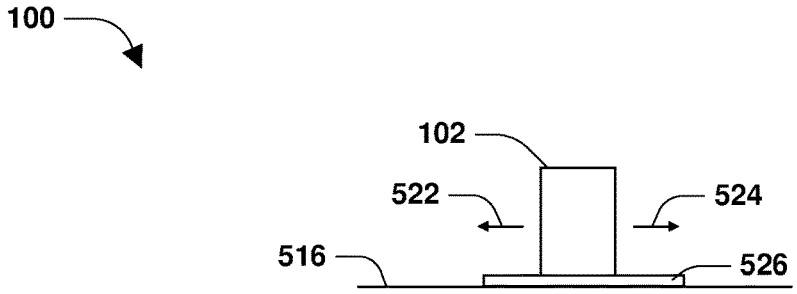
FIG. 5C illustrates a cross-sectional view of at least some of a plating system, in accordance with some embodiments.

FIG. 5C illustrates a cross-sectional view of the horizontal position adjustment component 526 of the barrier adjustment device 508, according to some embodiments. In some embodiments, the horizontal position adjustment component 526 is configured to adjust and/or control a horizontal position of the barrier 102. The horizontal position adjustment component 526 at least one of overlies, is in direct contact with, is in indirect contact with, or is coupled to the surface 516. The horizontal position adjustment component 526 is configured to adjust and/or control the horizontal position of the barrier 102 based upon at least one control signal of the one or more control signals 506. In some embodiments, the barrier 102 is coupled to the surface 516, such as via at least one of ball bearings, tracks, wheels, or other suitable connection. The horizontal position adjustment component 526 is coupled to the barrier 102, such as via at least one of a telescoping member or other suitable connection. In some embodiments, the horizontal position adjustment component 526 is configured to adjust and/or control the horizontal position of the barrier 102 by moving the barrier 102, such as using one or more motors of the horizontal position adjustment component 526, in at least one of a first horizontal direction 522 or a second horizontal direction 524 opposite the first horizontal direction 522. Other structures and/or configurations of the horizontal position adjustment component 526 and/or the barrier 102 are within the scope of the present disclosure.

Figure 5D:
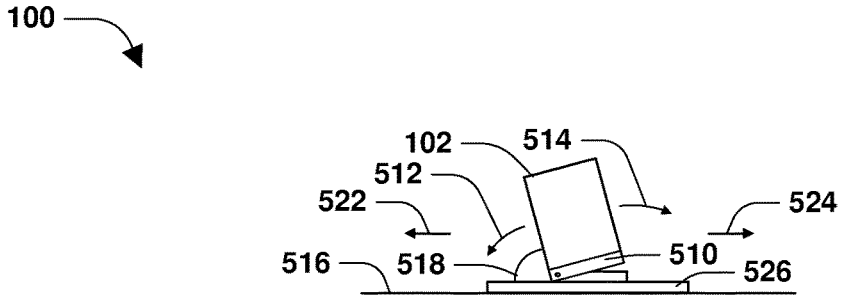
FIG. 5D illustrates a cross-sectional view of at least some of a plating system, in accordance with some embodiments.

FIG. 5D illustrates a cross-sectional view of the barrier adjustment device 508 comprising the angle adjustment component 510 and the horizontal position adjustment component 526, according to some embodiments. The angle adjustment component 510 is configured to adjust and/or control the angle 518 of the inner sidewall 520 of the barrier 102 with respect to the surface 516. The horizontal position adjustment component 526 is configured to adjust and/or control at least one of the horizontal position of the barrier 102 or a horizontal position of the angle adjustment component 510 coupled to the barrier 102. Other structures and/or configurations of the angle adjustment component 510, the horizontal position adjustment component 526 and/or the barrier 102 are within the scope of the present disclosure.

Figure 5E:
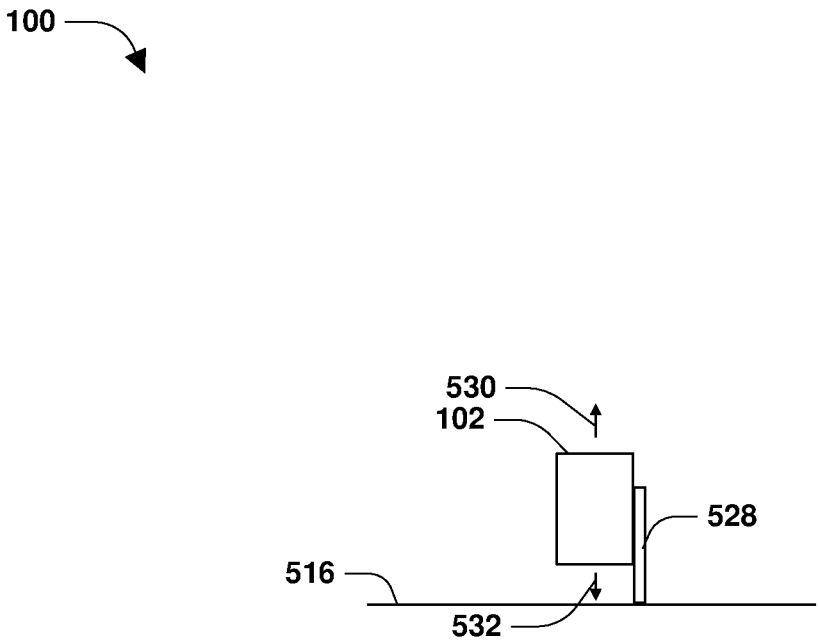
FIG. 5E illustrates a cross-sectional view of at least some of a plating system, in accordance with some embodiments.

FIG. 5E illustrates a cross-sectional view of the vertical position adjustment component 528 of the barrier adjustment device 508, according to some embodiments. In some embodiments, the vertical position adjustment component 528 is configured to adjust and/or control a vertical position of the barrier 102, such as based upon at least one control signal of the one or more control signals 506. The vertical position adjustment component 528 is coupled to the barrier 102, such as via at least one of a telescoping member or other suitable connection. In some embodiments, the vertical position adjustment component 528 is configured to adjust and/or control the vertical position of the barrier 102 by moving the barrier 102, such as using one or more motors of the vertical position adjustment component 528, in at least one of a first vertical direction 530 or a second vertical direction 532 opposite the first vertical direction 530. In some embodiments, the first vertical direction 530 is perpendicular to the first horizontal direction 522.

In some embodiments, at least one of the angle 518 of the inner sidewall 520 of the barrier 102 with respect to the surface 516, the horizontal position of the barrier 102, or the vertical position of the barrier 102 affect a direction of flow of reflected plating solution 140 reflected by the inner sidewall 520 of the barrier 102. Thus, the barrier adjustment device 508 can control the direction of flow of the reflected plating solution 140 by adjusting and/or controlling at least one of the angle 518 of the inner sidewall 520 of the barrier 102 with respect to the surface 516, the horizontal position of the barrier 102, or the vertical position of the barrier 102. In some embodiments, the controller 504 determines, based upon the one or more signals 502, one or more target portions of the surface 156 of the wafer 114. In some embodiments, the one or more target portions correspond to one or more portions of the surface 156 of the wafer 114 upon which the plating material is deposited at a deposition rate less than a threshold deposition rate. The threshold deposition rate corresponds to at least one of a second deposition rate at which the plating material is deposited on a different portion of the surface 156 of the wafer 114, a target deposition rate associated with the plating process, or another deposition rate. In some embodiments, the one or more target portions correspond to one or more portions of the surface 156 of the wafer 114 on which a thickness of deposited plating material is less than a threshold thickness. The threshold thickness corresponds to at least one of a second thickness of deposited plating material on a different portion of the surface 156 of the wafer 114, a target thickness associated with the plating process or another thickness. In some embodiments, the controller 504 controls the barrier adjustment device 508 to adjust at least one of the angle 518 of the inner sidewall 520 of the barrier 102 with respect to the surface 516, the horizontal position of the barrier 102, or the vertical position of the barrier 102 to adjust the direction of flow of the reflected plating solution 140 such that the reflected plating solution 140 impinges upon the one or more target portions and at least one of the deposition rate at which the plating material is deposited on the one or more target portions increases to at least the threshold deposition rate or the thickness of the deposited plating material on the one or more target portions increases to at least the threshold thickness.

In some embodiments, the controller 504 monitors the one or more feedback signals during the plating process, such as responsive to controlling the barrier adjustment device 508 to adjust at least one of the angle 518 of the inner sidewall 520 of the barrier 102 with respect to the surface 516, the horizontal position of the barrier 102, or the vertical position of the barrier 102. The controller 504 updates the control signal 506 periodically based upon the one or more signals 502. The controller 504 periodically determines one or more target portions of the surface 156 of the wafer 114 based upon the one or more signals 502. The controller 504 determines, based upon the one or more target portions of the surface 156 of the wafer 114, at least one of a target angle 518, a target horizontal position of the barrier 102, or a target vertical position of the barrier 102. The controller 504 generates the control signal 506 based upon at least one of the target angle 518, the target horizontal position of the barrier 102, or the target vertical position of the barrier 102. Responsive to a modification to and/or an update of the control signal 506, the barrier adjustment device 508 adjusts at least one of the angle 518, the horizontal position of the barrier 102, or the vertical position of the barrier 102 based upon the target angle 518, the target horizontal position of the barrier 102 and/or the target vertical position of the barrier 102 indicated by the control signal 506. Other configurations of the controller 504 and/or the barrier adjustment device 508 are within the scope of the present disclosure.

In some embodiments, plating process information associated with the plating process is stored by the controller 504, such as responsive to completion of the plating process. The plating process information is indicative of at least some of the one or more parameters of the plating process, the one or more properties of the plating solution 140, the material composition of the plating solution 140, the target plating thickness of the plating material on the surface 156 of the wafer 114, the target uniformity of the plating material on the surface 156 of the wafer 114, one or more thicknesses of the plating material deposited on one or more portions of the surface 156 in the plating process, a uniformity of the plating material deposited on the surface 156 in the plating process, or other suitable information. The controller 504 controls the barrier adjustment device 508 during one or more subsequent plating processes based upon the plating process information.

FIG. 6 illustrates a schematic view of the plating system 100 according to some embodiments. The plating system 100 comprises a bath 632 for preparing and/or containing the plating solution 140. The plating system 100 comprises at least one of a dosing system 602 or a real time analyzer (RTA) 604. The RTA 604 is configured to at least one of analyze or monitor a chemical composition of the plating solution 140. The dosing system 602 is configured to add additives to the plating solution 140, such as to replace additives consumed during plating. In some embodiments, the dosing system 602 regulates the chemical composition of the plating solution based upon one or more signals received from the RTA 604, such as by adding one or more additives to the bath 632. Other configurations of the bath 632, the dosing system 602 and/or the RTA 604 are within the scope of the present disclosure.

In some embodiments, the plating system 100 comprises at least one of one or more first pumps, one or more first filters, one or more first cells, or one or more first tubes. The one or more first cells comprise at least one of a first cell 638, a second cell 640, or a third cell 642. In some embodiments, the electroplating chamber 120 corresponds to at least one of the first cell 638, the second cell 640, or the third cell 642. The one or more first pumps comprise at least one of the first pump 610, the second pump 614, or the third pump 618. The one or more first filters comprise at least one of a first filter 612, a second filter 616, or a third filter 620. In some embodiments, the one or more first tubes comprise at least one of the first tube 650, the second tube 652, or the third tube 654.

In some embodiments, the first pump 610 is fluidly coupled to the bath 632. The first pump 610 is configured to conduct the plating solution 140 from the bath 632 into the first cell 638, such as via at least one of the first tube 650 or an inlet of the first cell 638 (such as the inlet 138 of the electroplating chamber 120). In some embodiments, the plating solution 140 is passed through the first filter 612 before entering the first cell 638. Other configurations of the first pump 610, the first tube 650, the first filter 612, and/or the first cell 638 are within the scope of the present disclosure.

In some embodiments, the plating system 100 comprises one or more return tubes. The one or more return tubes comprise at least one of a first return tube 622, a second return tube 624 or a third return tube 626. In some embodiments, the plating solution 140 is removed from the first cell 638, such as via an outlet of the first cell 638 (such as the outlet 104 of the electroplating chamber 120). Removed plating solution 140 removed from the first cell 638 is conducted to the bath 632, such as via the first return tube 622. Other configurations of the one or more first cells and/or the one or more return tubes are within the scope of the present disclosure.

In some embodiments, the plating system 100 comprises a recirculation system configured to recirculate and/or filter the plating solution 140. The recirculation system comprises at least one of a recirculation pump 634, a recirculation filter 636, or a recirculation tube 630. The recirculation pump 634 is fluidly coupled to the bath 632. The recirculation pump 610 is configured to at least one of conduct the plating solution 140 from the bath 632, pass the plating solution 140 through the recirculation filter 636, or conduct the plating solution 140 back into the bath 632, such as via the recirculation tube 630. Other configurations of the recirculation system are within the scope of the present disclosure.

Figure 7:
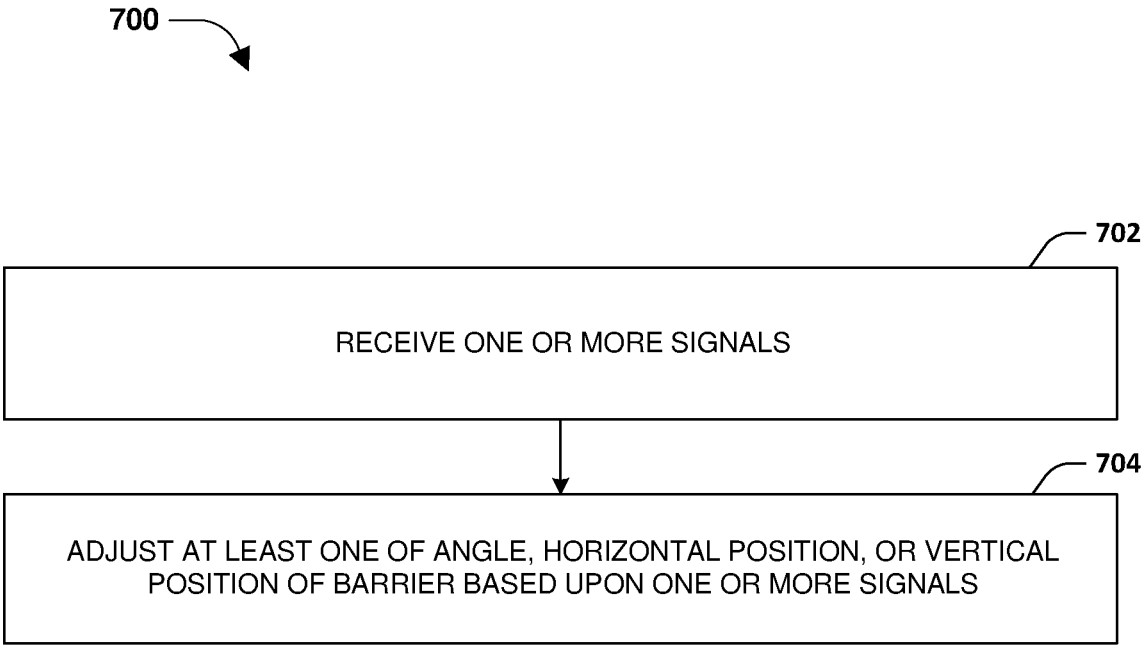
FIG. 7 is a flow diagram illustrating a method of controlling at least one of a position or an orientation of a barrier, in accordance with some embodiments.

A method 700 of controlling at least one of a position or an orientation of a barrier, such as the barrier 102, is illustrated in FIG. 7, in accordance with some embodiments. At 702, one or more signals, such as the one or more signals 502, are received. The one or more signals are received by a controller, such as the controller 504. At 704, at least one of an angle, a horizontal position, or a vertical position of the barrier are adjusted based upon the one or more signals. In some embodiments, the angle is at least one of the angle 518 of the inner sidewall 520 of the barrier 102 with respect to the surface 516, or another suitable angle. In some embodiments, the controller adjusts at least one of the angle, the horizontal position, or the vertical position of the barrier by transmitting a control signal, indicative of adjusting at least one of the angle, the horizontal position, or the vertical position of the barrier, to a barrier adjustment device, such as the barrier adjustment device 508. The control signal is at least one of the control signal 506 or another suitable control signal.

Figure 8:
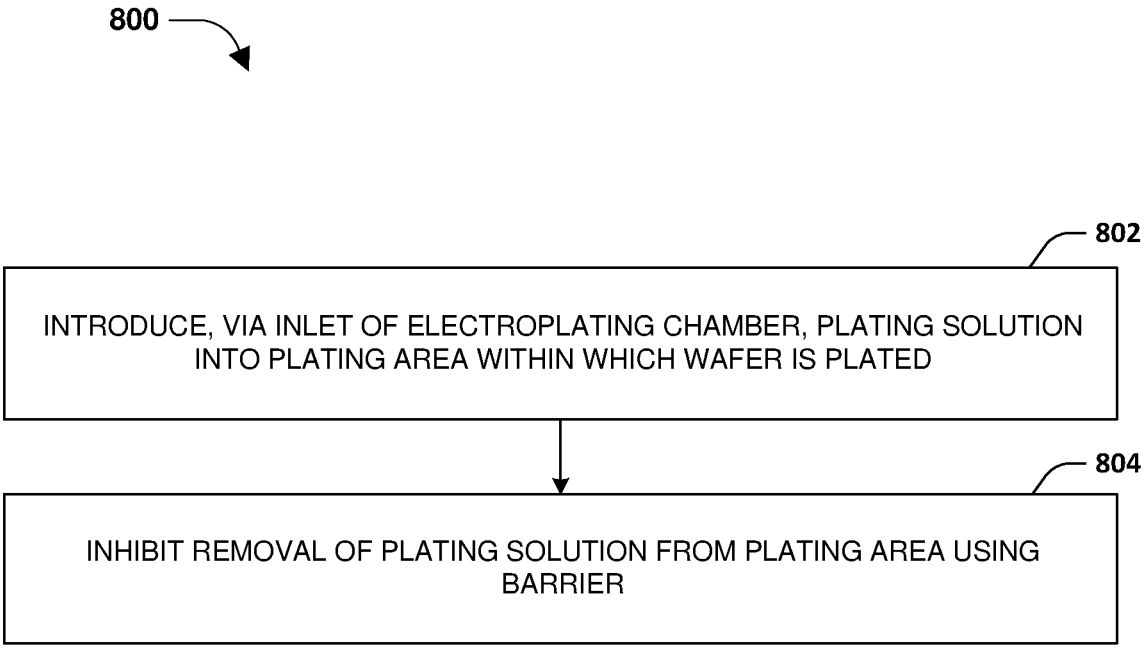
FIG. 8 is a flow diagram illustrating a method of plating a wafer, in accordance with some embodiments.

A method 800 of plating a wafer, such as the wafer 114, is illustrated in FIG. 8, in accordance with some embodiments. At 802, a plating solution is introduced, via an inlet of an electroplating chamber, into a plating region within which the wafer is plated. In some embodiments, the inlet is at least one of the inlet 138 or other suitable inlet. In some embodiments, the electroplating chamber is at least one of the electroplating chamber 120 or other suitable electroplating chamber. The plating solution is used for plating the wafer. In some embodiments, the plating solution is at least one of the plating solution 140 or other suitable plating solution. The plating region is defined by the electroplating chamber. In some embodiments, the plating region is at least one of the plating region 124 or other suitable plating region. At 804, removal of the plating solution from the plating region is inhibited using a barrier, such as the barrier 102.

Figure 9:
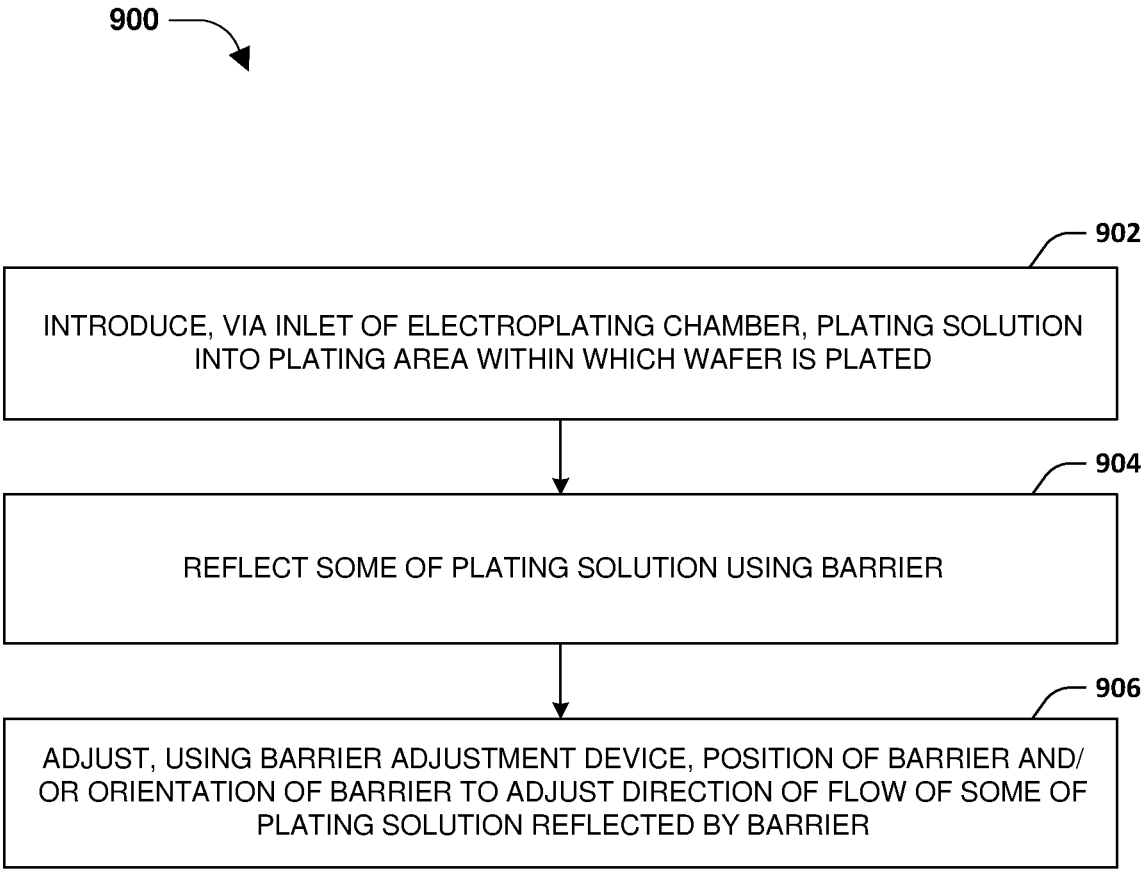
FIG. 9 is a flow diagram illustrating a method of plating a wafer, in accordance with some embodiments.

A method 900 of plating a wafer, such as the wafer 114, is illustrated in FIG. 9, in accordance with some embodiments. At 902, a plating solution is introduced, via an inlet of an electroplating chamber, into a plating region within which the wafer is plated. In some embodiments, the inlet is at least one of the inlet 138 or other suitable inlet. In some embodiments, the electroplating chamber is at least one of the electroplating chamber 120 or other suitable electroplating chamber. The plating solution is used for plating the wafer. In some embodiments, the plating solution is at least one of the plating solution 140 or other suitable plating solution. The plating region is defined by the electroplating chamber. In some embodiments, the plating region is at least one of the plating region 124 or other suitable plating region. At 904, some of the plating solution is reflected using a barrier, such as the barrier 102. The barrier overlies a HRVA, such as the HRVA 130, within the electroplating chamber. The some of the plating solution is reflected by an inner sidewall (such as the inner sidewall 168, the inner sidewall 202, the inner sidewall 302, or the inner sidewall 402), of the barrier, facing the plating region. At 906, at least one of a position of the barrier or an orientation of the barrier are adjusted using a barrier adjustment device to adjust a direction of flow of the some of the plating solution reflected by the barrier. In some embodiments, the barrier adjustment device is at least one of the barrier adjustment device 508 or another suitable barrier adjustment device. The position of the barrier corresponds to at least one of a vertical position of the barrier or a horizontal position of the barrier. The orientation of the barrier corresponds to an angle of the inner sidewall of the barrier with respect to a surface of the HRVA. The surface of the HRVA is at least one of the top surface 182 of the HRVA 130 or other suitable surface.

In some embodiments, one or more parameters of a plating process are sensed using one or more sensors. The plating process is performed for plating the wafer with anode material of an anode within the electroplating chamber (such as the anode 106). At least one of the position of the barrier or the orientation of the barrier are adjusted based upon the one or more parameters. The one or more parameters comprise at least one of one or more deposition rates, one or more plating thicknesses, one or more pressures of the plating solution in one or more parts of a plating system (such as the plating system 100) comprising the electroplating chamber, one or more directions of flow of the plating solution in one or more parts of the plating system, or other suitable parameters.

In some embodiments, the plating process is performed in at least one of middle end of line (MEOL) integrated circuit (IC) fabrication or back end of line (BEOL) IC fabrication. In some embodiments, the plating process is performed to form one or more interconnect structures, such as one or more vias, that provide connections between metal structures, such as at least one of one or more metal layers, one or more metal pads, one or more metal contacts, one or more metal terminals, etc. A first interconnect structure of the one or more interconnect structures passes through one or more dielectric layers to connect a first metal structure, such as at least one of a first metal layer, a first metal pad, a first metal contact, a first metal terminal, etc. to a second metal structure, such as at least one of a second metal layer, a second metal pad, a second metal contact, a second metal terminal, etc. In some embodiments, the plating process is performed to fill a trench, overlying the first metal structure, with the anode material of the anode, to form the first interconnect structure. The second metal structure is formed over the first interconnect structure and the first interconnect structure provides a connection between the first metal structure and the second metal structure.

Inclusion of the barrier and reflecting some of the plating solution using the barrier increases uniformity of flow or distribution of at least one of the plating solution or ions from the anode impinging upon the wafer, such as across a surface of the wafer, as compared to other systems and/or process that do not have the barrier to reflect some of the plating solution. In some embodiments, the increased uniformity of flow or distribution provides for improved interconnect structures, such as vias, in an edge region of the wafer, such as corresponding to the edge region 188 of the surface 156 of the wafer 114. In some plating processes where the barrier is not used to reflect some of the plating solution, a via formed on an edge region of a wafer has defects, such as air bubbles, voids, etc. and is generally of lower quality than a via formed on a center region of a wafer. However, including the barrier to reflect some of the plating solution in the plating process inhibits defects, such as air bubbles, voids, etc. in interconnect structures in the edge region of the wafer, such as at least due to the increased uniformity of flow or distribution of at least one of the plating solution or the ions impinging upon the wafer. Uniformity, such as with regard to dimensions, shapes, sizes, compositions, densities, etc. of structures, devices, etc., such as vias, transistors, etc., is improved across a wafer, die, etc. when the barrier is implemented as provided herein, which, in turn, improves yield of one or more semiconductor fabrication processes.

Figure 10:
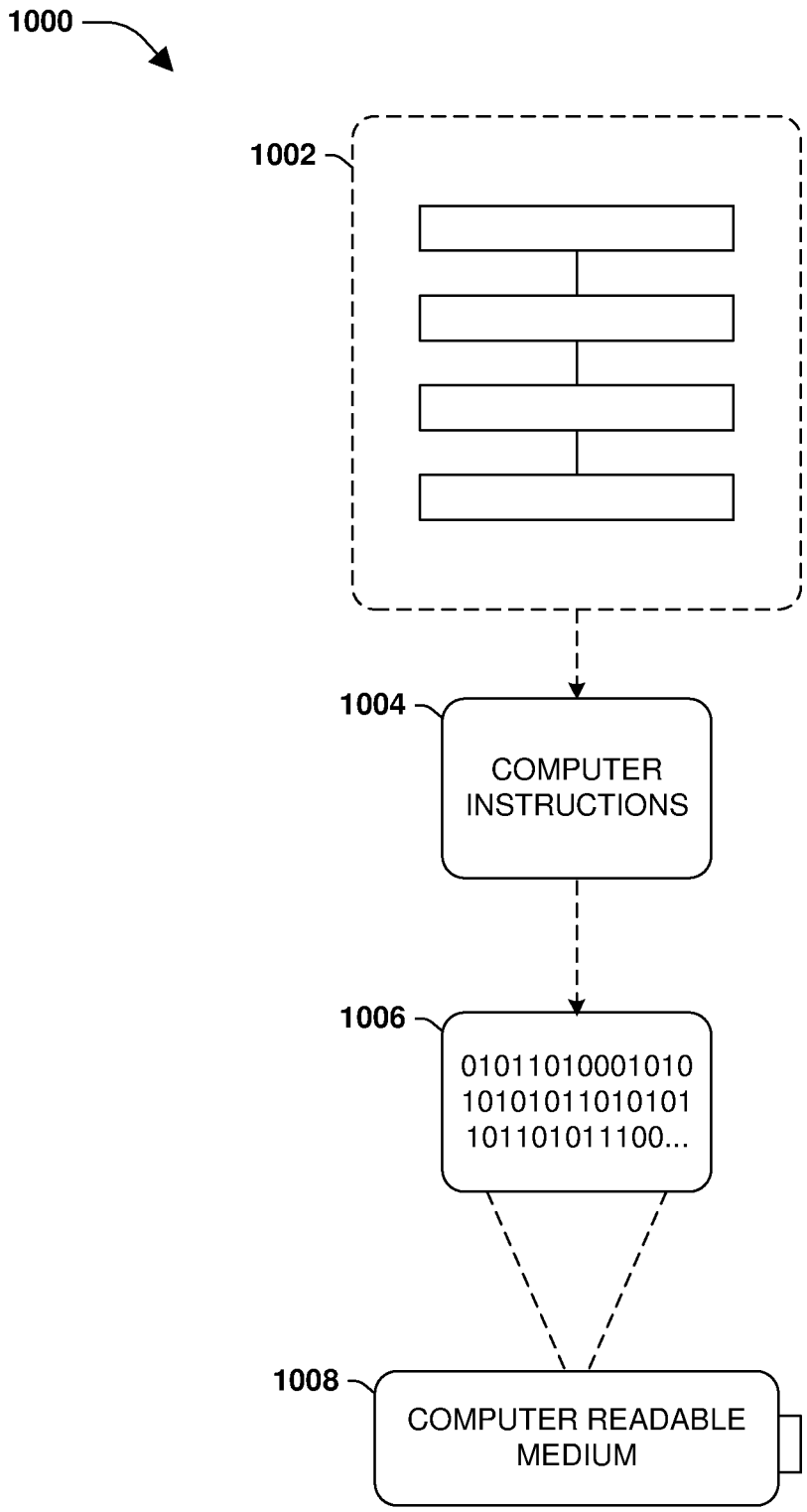
FIG. 10 illustrates an example computer-readable medium wherein processor-executable instructions configured to embody one or more of the provisions set forth herein may be comprised, according to some embodiments.

One or more embodiments involve a computer-readable medium comprising processor-executable instructions configured to implement one or more of the techniques presented herein. An exemplary computer-readable medium is illustrated in FIG. 10, wherein the embodiment 1000 comprises a computer-readable medium 1008 (e.g., a CD-R, DVD-R, flash drive, a platter of a hard disk drive, etc.), on which is encoded computer-readable data 1006. This computer-readable data 1006 in turn comprises a set of processor-executable computer instructions 1004 configured to implement one or more of the principles set forth herein when executed by a processor. In some embodiments 1000, the processor-executable computer instructions 1004 are configured to implement a method 1002, such as at least some of the aforementioned method(s) when executed by a processor. In some embodiments, the processor-executable computer instructions 1004 are configured to implement a system, such as at least some of the one or more aforementioned system(s) when executed by a processor. Many such computer-readable media may be devised by those of ordinary skill in the art that are configured to operate in accordance with the techniques presented herein.

In some embodiments, a plating system is provided. The plating system includes an electroplating chamber defining a plating region within which a wafer is plated. The electroplating chamber includes an inlet configured to introduce plating solution into the plating region of the electroplating chamber. The electroplating chamber includes an outlet configured to remove the plating solution from the plating region of the electroplating chamber. The plating system includes a barrier configured to inhibit removal of the plating solution from the plating region.

In some embodiments, a method of plating a wafer is provided. The method includes introducing, via an inlet of an electroplating chamber, a plating solution into a plating region within which the wafer is plated. The plating region is defined by the electroplating chamber. The plating solution is used for plating the wafer. The method includes inhibiting removal of the plating solution from the plating region using a barrier.

In some embodiments, a method of plating a wafer is provided. The method includes introducing, via an inlet of an electroplating chamber, a plating solution into a plating region within which the wafer is plated. The plating region is defined by the electroplating chamber. The plating solution is used for plating the wafer. The method includes reflecting some of the plating solution using a barrier. The barrier overlies a HRVA within the electroplating chamber. The some of the plating solution is reflected by an inner sidewall, of the barrier, facing the plating region. The method includes adjusting, using a barrier adjustment device, at least one of a position of the barrier or an orientation of the barrier to adjust a direction of flow of the some of the plating solution reflected by the barrier. The position of the barrier corresponds to at least one of a vertical position of the barrier or a horizontal position of the barrier. The orientation of the barrier corresponds to an angle of the inner sidewall of the barrier with respect to a surface of the HRVA.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

Although the subject matter has been described in language specific to structural features or methodological acts, it is to be understood that the subject matter of the appended claims is not necessarily limited to the specific features or acts described above. Rather, the specific features and acts described above are disclosed as example forms of implementing at least some of the claims.

Various operations of embodiments are provided herein. The order in which some or all of the operations are described should not be construed to imply that these operations are necessarily order dependent. Alternative ordering will be appreciated having the benefit of this description. Further, it will be understood that not all operations are necessarily present in each embodiment provided herein. Also, it will be understood that not all operations are necessary in some embodiments.

It will be appreciated that layers, features, elements, etc. depicted herein are illustrated with particular dimensions relative to one another, such as structural dimensions or orientations, for example, for purposes of simplicity and ease of understanding and that actual dimensions of the same differ substantially from that illustrated herein, in some embodiments. Additionally, a variety of techniques exist for forming the layers, regions, features, elements, etc. mentioned herein, such as at least one of etching techniques, planarization techniques, implanting techniques, doping techniques, spin-on techniques, sputtering techniques, growth techniques, or deposition techniques such as chemical vapor deposition (CVD), for example.

Moreover, "exemplary" is used herein to mean serving as an example, instance, illustration, etc., and not necessarily as advantageous. As used in this application, "or" is intended to mean an inclusive "or" rather than an exclusive "or". In addition, "a" and "an" as used in this application and the appended claims are generally be construed to mean "one or more" unless specified otherwise or clear from context to be directed to a singular form. Also, at least one of A and B and/or the like generally means A or B or both A and B. Furthermore, to the extent that "includes", "having", "has", "with", or variants thereof are used, such terms are intended to be inclusive in a manner similar to the term "comprising". Also, unless specified otherwise, "first," "second," or the like are not intended to imply a temporal aspect, a spatial aspect, an ordering, etc. Rather, such terms are merely used as identifiers, names, etc. for features, elements, items, etc. For example, a first element and a second element generally correspond to element A and element B or two different or two identical elements or the same element.

Also, although the disclosure has been shown and described with respect to one or more implementations, equivalent alterations and modifications will occur to others of ordinary skill in the art based upon a reading and understanding of this specification and the annexed drawings. The disclosure comprises all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure. In addition, while a particular feature of the disclosure may have been disclosed with respect to only one of several implementations, such feature may be combined with one or more other features of the other implementations as may be desired and advantageous for any given or particular application.

What is claimed is:

1. A plating system, comprising:
an electroplating chamber defining a plating region within which a wafer is plated, wherein the electroplating chamber comprises:
an inlet configured to introduce plating solution into the plating region of the electroplating chamber; and
an outlet configured to remove the plating solution from the plating region of the electroplating chamber;
a barrier configured to inhibit removal of the plating solution from the plating region;
a barrier adjustment device configured to adjust an angle of an inner sidewall of the barrier with respect to a surface underlying the barrier, wherein the inner sidewall of the barrier faces the plating region; and
a sensor configured to sense a parameter of a plating process whereby the wafer is plated with anode material of an anode within the electroplating chamber, wherein the barrier adjustment device adjusts the angle based upon a signal from the sensor indicative of the parameter.

2. The plating system of claim 1, wherein anode material is transferred from the anode to the wafer during the plating process.

3. The plating system of claim 1, wherein:
the wafer is over the barrier; and
the barrier is over the anode.

4. The plating system of claim 1, wherein an opening in the anode overlies the inlet of the electroplating chamber, and the plating system comprises:
a pump configured to conduct the plating solution into the plating region of the electroplating chamber via the inlet of the electroplating chamber.

5. The plating system of claim 1, wherein:
the inner sidewall of the barrier is tapered.

6. The plating system of claim 1, wherein the electroplating chamber comprises:
a cone overlying the wafer; and
a wafer support structure configured to maintain a position of the wafer between the anode and the cone.

7. The plating system of claim 1, comprising:
a rotational structure configured to rotate the wafer in the electroplating chamber.

8. The plating system of claim 1, wherein the parameter comprises at least one of a deposition rate, a plating thickness, or a pressure of the plating solution.

9. The plating system of claim 1, comprising:
a high resistance virtual anode (HRVA) within the electroplating chamber, wherein the barrier overlies the HRVA; and
a membrane within the electroplating chamber, wherein the membrane is between the anode and the HRVA.

10. The plating system of claim 8, wherein:
the HRVA is a porous structure through which the plating solution flows.

11. A plating system, comprising:
an electroplating chamber defining a plating region within which a wafer is plated, wherein the electroplating chamber comprises:
an inlet configured to introduce plating solution into the plating region of the electroplating chamber; and
an outlet configured to remove the plating solution from the plating region of the electroplating chamber;
a high resistance virtual anode (HRVA) within the electroplating chamber;
a barrier, overlying the HRVA, configured to inhibit removal of the plating solution from the plating region;
a barrier adjustment device configured to adjust an angle of an inner sidewall of the barrier with respect to a surface underlying the barrier, wherein the inner sidewall of the barrier faces the plating region; and
a sensor configured to sense a parameter of a plating process whereby the wafer is plated with anode material of an anode within the electroplating chamber, wherein the barrier adjustment device adjusts the angle based upon a signal from the sensor indicative of the parameter.

12. The plating system of claim 11, wherein the HRVA is between the anode and the wafer.

13. The plating system of claim 11, wherein:
the wafer is over the barrier.

14. The plating system of claim 11, wherein the electroplating chamber comprises:
a cone overlying the wafer; and
a wafer support structure configured to maintain a position of the wafer between the anode and the cone.

15. The plating system of claim 11, comprising:
a membrane within the electroplating chamber, wherein the membrane is between the anode and the HRVA.

16. The plating system of claim 11, wherein the parameter comprises at least one of a deposition rate, a plating thickness, or a pressure of the plating solution.

17. A plating system, comprising:
an electroplating chamber defining a plating region within which a wafer is plated, wherein the electroplating chamber comprises:
an inlet configured to introduce plating solution into the plating region of the electroplating chamber; and an outlet configured to remove the plating solution from the plating region of the electroplating chamber;

an anode within the electroplating chamber, wherein:

an opening in the anode overlies the inlet of the electroplating chamber; and anode material from the anode is transferred from the anode to the wafer during a plating process;

a pump configured to conduct the plating solution into the plating region of the electroplating chamber via the inlet of the electroplating chamber;

a high resistance virtual anode (HRVA) within the electroplating chamber, wherein:

the HRVA is over the anode;

the HRVA is a porous structure through which the plating solution flows; and the HRVA comprises non-conductive material;

a barrier, overlying the HRVA, configured to inhibit removal of the plating solution from the plating region;

a barrier adjustment device configured to adjust an angle of an inner sidewall of the barrier with respect to a surface underlying the barrier, wherein the inner sidewall of the barrier faces the plating region; and a sensor configured to sense a parameter of a plating process whereby the wafer is plated with the anode material of the anode, wherein the barrier adjustment device adjusts the angle based upon a signal from the sensor indicative of the parameter.

18. The plating system of claim 17, wherein the electroplating chamber comprises:

a cone overlying the wafer; and a wafer support structure configured to maintain a position of the wafer between the anode and the cone.

19. The plating system of claim 17, comprising:

a membrane within the electroplating chamber, wherein the membrane is between the anode and the HRVA.

20. The plating system of claim 17, wherein the sensor is at least one of a proximity sensor, an optical sensor, an image sensor, a camera, an infrared sensor, or a pressure sensor.

* * * * *